US005185969A

United States Patent [19]

Vanderwal, Jr.

[11] Patent Number: 5,185,969

[45] Date of Patent: Feb. 16, 1993

[54] POSITIVE RETRACTING HONING MANDREL

[75] Inventor: Frank E. Vanderwal, Jr., Frontenac, Mo.

[73] Assignee: Sunnen Products Company, St. Louis, Mo.

[21] Appl. No.: 811,816

[22] Filed: Dec. 20, 1991

[51] Int. Cl.[5] ..... B24B 9/02

[52] U.S. Cl. ..... 51/338; 51/355; 51/345

[58] Field of Search ..... 51/355, 345, 338

[56] References Cited

U.S. PATENT DOCUMENTS

| | | | |
|---|---|---|---|
| 2,350,969 | 6/1944 | Sunnen | 51/338 |
| 2,376,850 | 5/1945 | Sunnen | 51/338 |
| 2,376,851 | 5/1945 | Sunnen | 51/355 |
| 2,532,682 | 12/1950 | Sunnen | 51/338 |
| 2,799,127 | 7/1957 | Sunnen | 51/338 |
| 3,225,496 | 12/1965 | Sunnen | 51/355 |
| 4,249,348 | 2/1981 | Rutter | 51/338 |
| 4,254,591 | 3/1981 | Sedgwick | 51/338 |
| 4,462,189 | 7/1984 | Puybaraud | 51/338 |
| 4,471,576 | 9/1984 | Corley | 51/338 |

*Primary Examiner*—Bruce M. Kisliuk
*Assistant Examiner*—Bo Bounkong
*Attorney, Agent, or Firm*—Haverstock, Garrett and Roberts

[57] ABSTRACT

An improved radially expandable honing mandrel construction wherein a radially extendable work engaging portion can be positively retracted into the body member of the mandrel by operation of the adjusting member in a direction opposite its direction for expanding the work engaging portion, which positively retracting feature comprises a surface adjacent one side of the work engaging portion and a tab extending from the side of the adjusting member for engagement with the surface to retract the work engaging member when the adjusting member is operated in a direction opposite from that used for expanding the work engaging member, the surface and tab also cooperating to retain the work engaging portion in the mandrel. The invention also includes structure on the mandrel engageable with the adjusting member to prevent lateral movements thereof in the body member.

25 Claims, 3 Drawing Sheets

POSITIVE RETRACTING HONING MANDREL

The present invention relates generally to honing mandrels, and more particularly, to means for positively retracting and retaining the radially expanded or extended work engaging portions of a honing mandrel. The present retracting means can positively retract or withdraw abrasive members, stone assemblies or other work engaging portions of a honing mandrel into the mandrel body portion for decreasing or otherwise adjusting the cross-sectional size and rotational or honing diameter of the mandrel for such purposes as enabling automatic and robotic loading of parts and preventing scratching or other damage to the interior surface of a bore or other cavity as the mandrel is inserted into the bore or withdrawn therefrom. The present means can also prevent a work engaging portion from flying out of the mandrel as it is rotated and retain the work engaging portion in the mandrel to prevent loss of or damage to the work engaging portion and for safer operation. The retracting means are further operable without tilting, lifting or other mispositioning of adjusting or operating means such as wedge members and the like which actuate the extension and retraction of the radially movable work engaging portion or portions. The present retracting and retaining means are adaptable for use with a wide variety of radially expandable honing mandrel constructions including those used for honing relatively small bores and particularly for mandrel constructions such as shown in Sunnen U.S. Pat. No. 2,376,851, and can further be adapted for use with any number of other expandable or extendable type tools or other devices.

BACKGROUND OF THE INVENTION

Honing mandrels and other tools having a variety of radially or sidewardly extendable or expandable work engaging portions are well known in the art. Known expandable honing mandrel constructions such as shown in Sunnen U.S. Pat. No. 2,376,851, can include one or more work engaging portions such as abrasive stone assemblies or the like which portions are radially expanded or extended by the manipulation or other movement of adjusting or operator means such as an adjusting or wedge member extending through a passageway or slot in the mandrel body. Moving the adjusting or wedge member in a first longitudinal direction in the slot supportively engages and radially extends the stone assembly or other work engaging portion such that the surfaces thereof engage and apply or exert radially directed pressure against an internal surface of a bore or hole or other surface of a workpiece to be honed. When a honing operation is complete or it is otherwise desired to withdraw the honing mandrel from a bore, the wedge member can be moved in a second direction to remove support for the stone assembly and relieve the radially outwardly directed honing pressure enabling the stone assembly to freely move or retract radially inwardly. The stone assembly can then be partially pressed or urged into the mandrel by engagement of the stone with the surface of the bore as the mandrel is withdrawn therefrom. Such known mandrels can also include stone retainer means which bias the stone assembly radially inwardly to some extent.

One shortcoming of such known radially expandable honing mandrel constructions is that the stone assembly may not be fully retracted from contact with the surface of the bore and by the stone retaining means which may further act only to retract one end of the stone assembly such that the opposite end remains extended. This can then require manually or otherwise pinching or pressing the stone assembly more fully into the mandrel to make the mandrel diameter small enough to be inserted into the next part to be honed which will have a smaller bore than the previous honed part. The requirement of pressing the stone assembly into the mandrel takes more time, provides an opportunity for mishandling and makes automatic or robotic parts loading more difficult. Another shortcoming is that the stone assembly can cause scratches or other damage on the honed surface if the extended stone assembly is pressed into the mandrel by contact with the honed surface as the mandrel is withdrawn from the bore.

Another shortcoming of some known constructions is that the stone assemblies are not adequately retained or maintained in the mandrel body enabling the stone assemblies to fly out or become misaligned or mispositioned in the mandrel and damaged or lost due to the centrifugal force created as the mandrel is rotated outside of a part. Still another shortcoming can be mispositioning and lifting or tilting of the wedge member or other operator means as the wedge member is moved for removing support for the work engaging portion.

Other known mandrel constructions such as shown in Sunnen U.S. Pat. Nos. 2,376,850, and 2,421,470, disclose hone sections having angularly extending projections adapted to seat and slide in grooves of an adjusting bar to produce radial movement inwardly and outwardly of the hone sections as the adjusting bar is moved in opposite axial directions. An important limitation of such known constructions, however, is that they are not particularly adaptable for use in mandrels for honing relatively small bores such as below one inch and as small as 0.1 inch in diameter as the angularly extending projections would become too small for supporting the hone sections and the adjusting bar would become too narrow at the grooves to withstand the honing pressures used in many honing operations.

Contrasted to the relatively limited constructions discussed above, the subject invention relates to relatively uncomplicated, reliable and trouble free means for positively retracting and retaining the radially expandable work engaging portions of a honing mandrel for such purposes as facilitating automatic and robotic parts loading, reducing damaging contact between the work engaging portion and the honed surface, preventing the work engaging portion from flying out of the mandrel or becoming mispositioned or lost and preventing tilting of the adjusting or operator means, which retracting and retaining means can be made for use with a wide variety of mandrel constructions including for honing relatively small bores.

SUMMARY OF THE INVENTION

The present invention overcomes many of the shortcomings and limitations associated with known radially expandable honing mandrels and teaches the construction and operation of means for positively retracting or drawing in and retaining any number of radially extended work engaging portions of a honing mandrel such as abrasive stone assemblies and the like. The present retracting means can positively retract or draw radially extendable work engaging portions of a honing mandrel into the mandrel body so as to reduce the radial or cross-sectional size of the mandrel. This enables automatically reducing the size of the mandrel for such purposes as eliminating manual operations to press the work engaging portion into the mandrel to enable inserting the mandrel into parts having smaller bores, for facilitating automated parts loading, and to enable withdrawing the mandrel from a bore with sufficient clearance provided around the work engaging surfaces so as to avoid contacting and rubbing or scratching or otherwise damaging the honed surfaces or the mandrel itself. The retracting means can also be used for such purposes as decreasing or adjusting the diameter of rotation or honing diameter of a rotating mandrel as defined by the radially extended outermost portions thereof. The present means further can retain the radially movable work engaging portions in the mandrel to prevent the work engaging portions from flying out of the mandrel as it is rotated outside of a bore for safety reasons, and from dropping or being jarred or otherwised loosened or mispositioned or detached from the mandrel and being damaged or lost.

The present retracting means comprise portions or surfaces on the radially extendable stone assembly or other work engaging portion and on the operator or adjusting member of a mandrel which are cooperatively engageable to retract or draw the stone assembly radially into the body of the mandrel by movement of the adjusting member in a direction different than that for extending the stone assembly. Importantly, the present means are also cooperatively engageable without movement of the adjusting member for retaining the stone assembly in the mandrel when centrifugal or other outward forces or gravity act to urge the stone assembly radially out of the mandrel. The preferred cooperatively engageable portions or surfaces are slidably engageable for retracting the stone assembly, at least one of which portions or surfaces being inclined at an acute angular relation to the axis of the mandrel to form a cam or wedge which pushes or draws or otherwise positively retracts the stone assembly radially inwardly into the mandrel body as the adjusting member is moved in the direction opposite to that for radially extending the stone assembly. The angular orientation of the inclined cam surface or surfaces is further preferably the same as that of cam or wedge surfaces or other means for radially extending the stone assembly such that radial inward and outward displacement may be relatively equal for a given longitudinal displacement or movement of the adjusting member in either direction.

The cam surface is preferably located adjacent to one side of the stone assembly and comprises an inclined edge or side portion of a groove or recess formed in the side of the backing or support portion of the stone assembly, the cam groove receiving an outwardly or sidewardly extending projecting portion or pin or tab on the adjusting member. The tab can also have an inclined or cam surface oriented at a corresponding angle to the groove for better and smoother operation and engagement with the cam groove. The cam groove can also include an axially extending groove portion or recess along which the tab can pass after the adjusting member has moved far enough in the direction for retracting the stone assembly to fully retract the stone assembly and yet maintain the tab in the groove and subsequently for disassembly and removal of the adjusting member and stone assembly from the mandrel. In alternative embodiments, the cam surface can extend outwardly from the stone assembly or other work engaging member or can be located on the operator member and the pin or tab can be located on the work engaging member, as desired. A honing mandrel can further have any number of the present means associated therewith for retracting and retaining any number of work engaging portions, for instance, a longer stone assembly can have a plurality of retracting means therefor, or a honing mandrel having a plurality of stone assemblies could have retracting means for each.

To prevent tilting or lifting of the wedge or operating member in open sided mandrel constructions wherein the end of the wedge member engaged with the stone assembly can move radially or raise from its location in the open sided slot or passageway of the mandrel as the adjusting member is moved to retract the stone assembly, containment means for maintaining the adjusting member bottomed in the slot or passageway of the mandrel body are preferably provided. Containing radial movement of the wedge member enables more precise and accurate adjusting of the honing diameter and pressure and further ensures positive disengagement of the abrasive stone assembly from the surface being honed when the wedge member is operated to retract the stone assembly. The containment means can comprise various suitable means or structure for containing and preventing tilting, lifting or other radial or lateral movement of a portion or all of the adjusting member, several alternative preferred embodiments including a block member having a sidewardly extending portion overhanging the adjusting member that can be adhesively or otherwise attached to the mandrel body in the slot or passageway thereof, or by peening or staking one or more portions of the edge of the wedge slot so as to extend over the adjusting member, or by use of a pin or other member which cooperatively engages and retains the wedge member.

Other important features of the present retracting and retaining means include the ability of the means to be easily adapted for use on a wide variety of honing mandrel constructions without requiring substantial, if any, modification of the components of the mandrel such as machining and other metal working or forming. Further, the present means can be incorporated into relatively small mandrel constructions such as for honing bores of less than one inch diameter and as small as 0.1 inch diameter or even smaller without the wedge member being weakened so as to bend or otherwise deform when pressure is applied to expand the mandrel or during honing. The present retracting means can be operated by the movement of the adjusting member in the direction opposite that to radially extend or expand the mandrel such that no additional operations or movements are required of means in the honing machine on which the honing mandrel is mounted, which honing machine and operating means thereof are not part of the present invention. The present means are further relatively simple structurally and are economical to incorporate into a honing mandrel and are relatively trouble free in operation.

It is therefore a principal object of the present invention to provide a honing tool having a work engaging portion which can be positively retracted for adjusting the honing diameter of the tool and for other purposes.

Another object is to eliminate the need for manually pressing a radially extended work engaging portion of a honing mandrel into the mandrel body.

Another object is to provide a honing tool which will not scratch or otherwise damage the interior surface of a bore as the honing tool is inserted into and withdrawn therefrom.

Another object is to provide means to prevent a radially extendable portion of a honing mandrel from flying out of the mandrel as it is rotated.

Another object is to provide means to prevent dislocation and loss or damage to a stone assembly of a honing mandrel.

Another object is to provide means for positively retracting the stone assembly on a honing mandrel without lifting or tilting the adjusting means therefor.

Another object is to provide means for positively retracting and retaining the stone assembly in a retracted condition on a honing mandrel, which means are relatively simple, inexpensive to make and install and can be readily incorporated into existing honing mandrel constructions.

Another object is to provide means for adapting a radially expandable honing mandrel assembly to be positively retractable without requiring extensive modification or machining of the mandrel or mandrel components.

Another object is to provide positive retracting means which can be used with an existing mandrel body.

Another object is to facilitate automatic and robotic parts loading for honing operations.

Another object is to provide positive retracting means which are adapted for use on a variety of honing mandrel constructions including mandrels for honing relatively small bores.

Another object is to make honing safer.

These and other objects and advantages of the present invention will become apparent to those skilled in the art after considering the following detailed specification of preferred embodiments in conjunction with the accompanying drawings wherein:

DETAILED DESCRIPTION OF THE PREFERRED EMBODIMENTS

Figure 1:
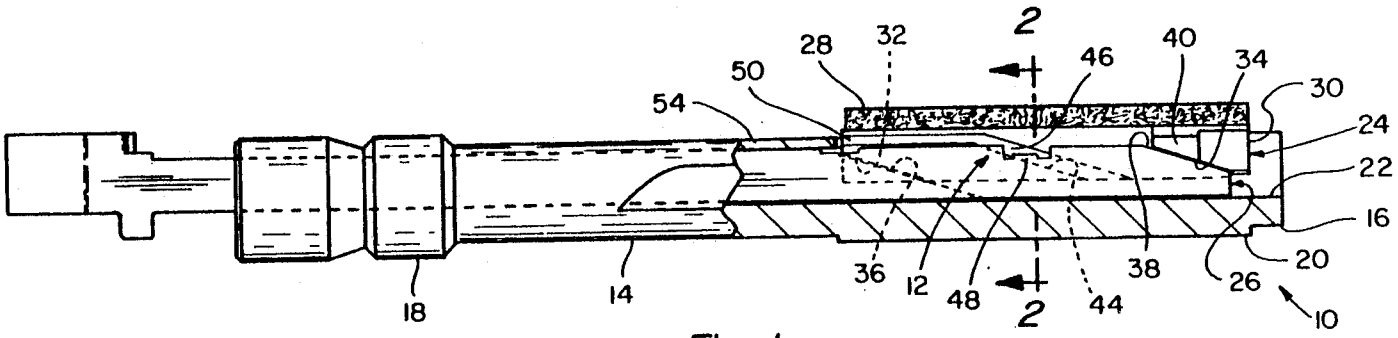
FIG. 1 is a partial cross-sectional side elevational view of a honing mandrel showing the wedge member and stone assembly thereof and means for positively retracting the stone assembly constructed according to the teachings of the present invention.
Figure 4:
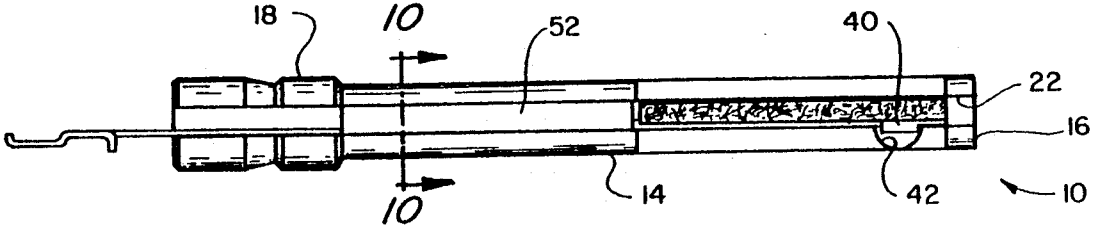
FIG. 4 is a top plan view of the honing mandrel of FIG. 1.
Figure 11:
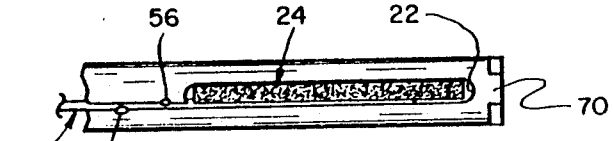
FIG. 11 is a fragmentary top plan view of an alternative construction of the honing mandrel of FIG. 1.

Referring to the drawings more particularly by reference numbers, wherein like numerals refer to like parts, number 10 in FIG. 1 refers to a radially expandable honing mandrel including means 12 for positively retracting and retaining the work engaging honing portions of the mandrel, said retracting and retaining means being constructed according to the teachings of the present invention. The retracting and retaining means 12 can be incorporated in a wide variety of different honing mandrel constructions, the basic honing mandrel construction shown being more fully disclosed for example in Sunnen U.S. Pat. No. 2,376,851. The mandrel 10 has a shank portion 14 which extends between a work engaging honing portion 16 at a first or forward end of the mandrel 10, and a cylindrical mounting portion 18 at the opposite or rear end of the mandrel. The honing portion 16 has shoe portions 20 on one side which shoe portions 20 are work engaging portions for engaging a surface to be honed. A slot or cavity 22 is formed extending into the side of the mandrel 10 substantially opposite the shoe portions 20, the slot 22 providing a passageway along the length of the mandrel 10. The slot 22 can be open at both axial ends thereof, as shown in FIG. 4, or alternatively, the axial end of the slot 22 adjacent the work engaging end 16 of the mandrel can be closed, as shown in FIG. 11 and discussed below. The slot 22 cooperatively receives an elongated abrasive or honing stone assembly 24 adjacent to one side thereof positioned for radial movement therein, and an elongated operator or adjusting or wedge member or assembly 26 adjacent to the opposite side, which wedge member 26 extends substantially the length of the mandrel 10 and is longitudinally or axially operable therein.

Figure 3:
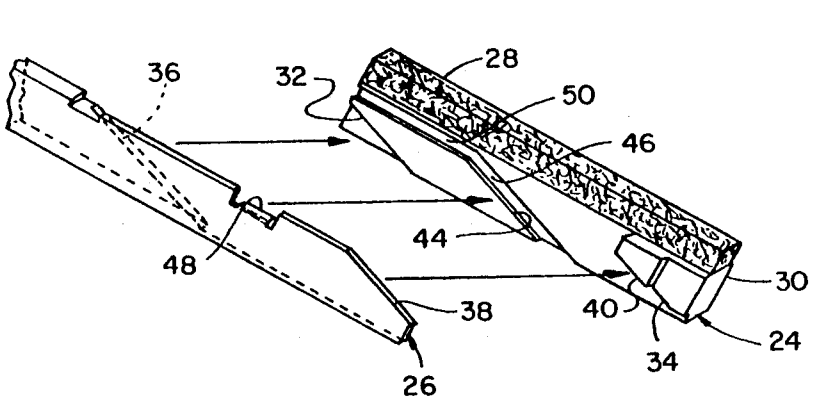
FIG. 3 is a fragmentary exploded perspective view of the wedge member and stone assembly of FIG. 1.

The stone assembly 24 comprises an abrasive work engaging or honing stone portion 28 extending outwardly relative to the mandrel 10 and a backing or stone support portion 30 which extends into the slot 22. The backing portion 30 includes a pair of parallel spacedly related angular or inclined cam or wedge surfaces 32 and 34 oriented at an acute angle relative to the axis of the mandrel body and located adjacent to the opposite ends of the stone assembly 24, as shown in FIGS. 1 and 3. The angular cam surfaces 32 and 34 are cooperatively and slidably engageable with correspondingly inclined and parallel cam or wedge surfaces 36 and 38 formed on the adjusting or operator member 26. The stone support or backing portion 30 can further include means for preventing axial movement of the stone assembly 24 in the slot 22, such as the sidewardly extending portion or lug 40 shown located adjacent the cam surface 34. The lug 40 can be located on either side of the stone assembly 24 at any desired location along the length thereof and is cooperatively receivable in a slot or cut-out formed in the mandrel 10, such as the cut-out 42 shown in FIG. 4, for preventing longitudinal or axial but not radial movement of the stone assembly 24 in the slot 22.

Figure 2:
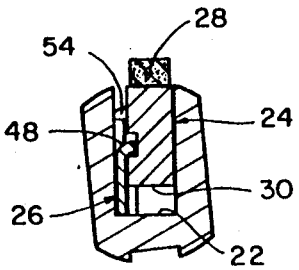
FIG. 2 is a cross-sectional view taken along line 2—2 of FIG. 1 and showing the stone assembly in a radially extended position.
Figure 5:
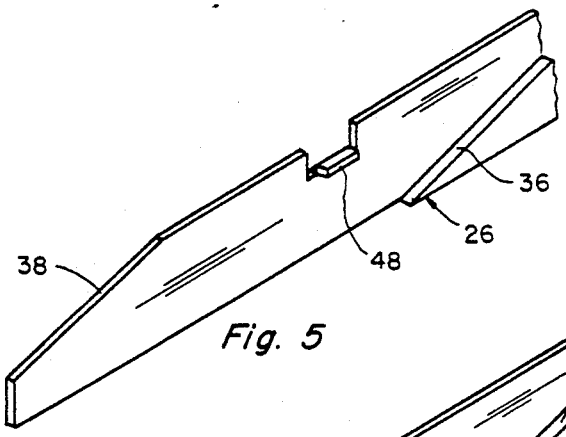
FIG. 5 is an enlarged fragmentary perspective view of the wedge member of FIG. 1, showing the retracting means associated therewith.

The wedge member 26 is an elongated member preferably formed of a thin metal strip with parallel upper and lower edges, cam surfaces 36 and 38 being parallel but offset, each being approximately one-half the thickness of the wedge member as best shown in FIGS. 3 and 5. The stone assembly 24 and the wedge 26 are mounted in side by side relation in the slot 22 so that together they have a width approximately equal to the width of the slot 22, as shown in FIG. 2. The stone assembly 24 is also radially movable in the slot 22 to any number of radially extended positions such as shown in FIGS. 1 and 2 by the longitudinal or axial movement of the wedge member 26 along the slot 22 providing the passageway along the mandrel 10. Such longitudinal movement of the wedge member 26 causes cam surfaces 36 and 38 thereon to slidably and supportively engage the cam surfaces 32 and 34 on the stone assembly 24 so as to radially move the stone assembly 24 by an amount corresponding with the longitudinal movement or displacement of the wedge member 26. The stone assembly 24 is radially moved in the usual manner to increase or expand the diameter of rotation or honing diameter of the mandrel 10 such that the work engaging portions of the mandrel contact and engage under pressure an internal surface of a bore, hole or other surface on a workpiece to be honed.

The retracting means 12 are operable to positively withdraw or retract the stone assembly 24 into the slot 22 to reduce the cross-sectional size of the mandrel and decrease or contract the diameter of rotation or honing diameter of the rotating mandrel for purposes such as to enable inserting the mandrel 10 into a bore or other surface or passageway to be honed or removing the mandrel 10 therefrom without the work engaging surfaces of the mandrel contacting or rubbing on and damaging the surface of the workpiece or the mandrel itself. The retracting means 12 additionally retain or maintain the stone assembly 24 in the slot 22 such that when the mandrel 10 is not in a bore or other cavity to be honed, the stone assembly 24 will not fly out of the slot 22 due to centrifugal force produced by rotating the mandrel and possibly cause damage or injury or otherwise fall or drop such as by gravity or otherwise become mispositioned in the slot 22.

Figure 7:
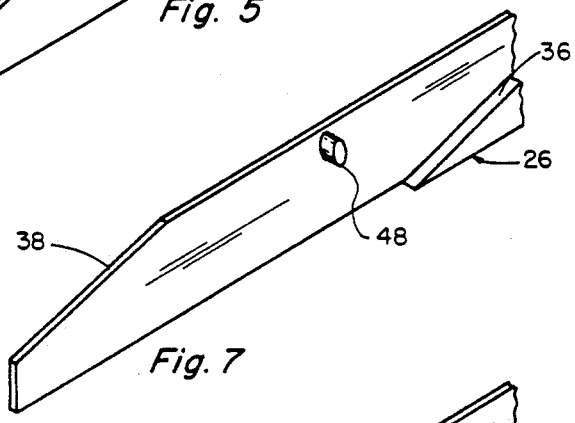
FIG. 7 is an enlarged fragmentary perspective view of the wedge member of FIG. 1, showing another alternative retracting means associated therewith.
Figure 6:
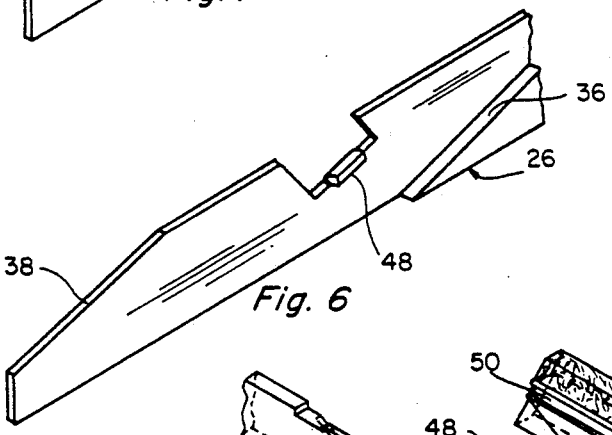
FIG. 6 is an enlarged fragmentary perspective view of the wedge member of FIG. 1, showing alternative retracting means associated therewith.
Figure 9:
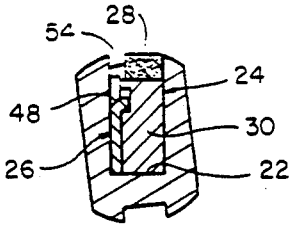
FIG. 9 is a cross-sectional view taken along line 9—9 of FIG. 8.
Figure 8:
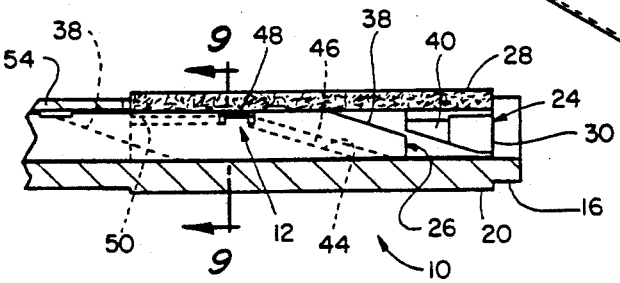
FIG. 8 is a fragmentary partial cross-sectional side elevational view of the honing mandrel of FIG. 1, showing the stone assembly thereof in a retracted position.

The retracting and retaining means 12 are important to the invention and comprise cooperatively engageable means on the stone assembly 24 and wedge member 26 which enable the wedge member 26 to be moved or withdrawn to retract or otherwise adjust the radial location of the stone assembly 24. The cooperatively engageable retracting means 12 preferably include a cam surface 44 defining the edge or side of a recess or inclined groove portion 46 formed on the side of the backing portion 30 of the stone assembly 24. The cam surface 44 is oriented at an acute angle to the axis of the mandrel body 10 and is preferably parallel to but facing in a direction opposite to the wedge surfaces 32 and 34. The retracting means also include a tab or projection 48 extending sidewardly from the wedge member 26 which tab 48 is cooperatively receivable in the groove portion 46 and operable therein so as to be cooperatively and slidably engageable with the cam surface 44, as shown in FIGS. 1 and 3. The sidewardly extending tab 48 can have any suitable shape for operation in the groove 46 such as the elongated axially extending shape shown in FIG. 5, or alternatively can be inclined such as at the same angular orientation as the groove 46 for smoother operation therein as shown in FIG. 6, or can have a cylindrical or other shape such as shown in FIG. 7. The tab 48 slidably engages the cam surface 44 as the wedge member 26 is moved axially in the slot 22 toward the mounting end 18 of the mandrel to draw the stone assembly radially into the slot 22, which direction of movement is opposite from the direction of movement for expanding the honing diameter. When the stone assembly 24 is fully retracted, such as shown in FIGS. 8 and 9, any further movement of the wedge member 26 in the retracting direction will cause the tab 48 to move into a connecting axially extending groove portion or recess 50 formed in the same side of the backing portion 30 of the stone assembly. The connecting groove portion 50 enables the wedge member 26 to be further moved or withdrawn longitudinally in the retracting or second direction while the tab 48 retains the stone assembly 24 in the mandrel without binding. The groove 50 being open ended allows eventual complete disengagement of the tab 48 from the stone assembly 24 for allowing removal of both assemblies 24 and 26 from the mandrel 10. The engagement of the tab 48 with the inclined groove portion 46 and with the axial groove portion 50 also prevents the stone assembly 24 from flying out of the mandrel 10, as discussed above due to centrifugal or other forces including gravity or from falling and/or being jarred or knocked loose from the mandrel 10. The engagement also enables the stone assembly 24 to be easily removed from the mandrel by additional retracting movement of the wedge member 26 or to be similarly easily installed.

Figure 10:
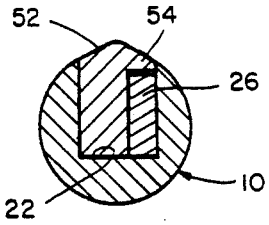
FIG. 10 is a cross-sectional view taken along line 10—10 of FIG. 4.

When a stone assembly is engaged with the surface of a bore during honing and it is desired to retract or relieve pressure on the stone assembly, retraction or withdrawl of the wedge member in prior known mandrel constructions often produced a tendency for the end of the wedge member adjacent to the honing end of the mandrel to be lifted or tilted in the slot of the mandrel. To prevent such tendency for mispositioning or misalignment of the wedge member 26, the present construction preferably includes means to retain the wedge member 26 in position extending at all times along the bottom of the mandrel slot 22 while not limiting axial freedom of movement of the wedge member. Such containment means can take many different forms, several of which are shown and described. One embodiment particularly well adapted for use with mandrel bodies having a slot 22 of substantially uniform width along the length thereof such as shown in FIG. 1, is to partially or fully cover an open intermediate or shank portion of the slot 22 adjacent to the stone assembly 24 by positioning and attaching block member 52 adhesively or otherwise in the slot 22 adjacent to the wedge member 26, as best shown in FIGS. 4 and 10. The block member 52 is an elongated member sized and shaped to be positioned in the slot 22 adjacent to one side thereof with sufficient space adjacent to the opposite side for receiving the axially movable wedge member 26. The block 52 includes a sidewardly extending or overhanging portion 54 which extends over a portion of the length of the wedge member 26 to prevent it from lifting or moving radially in the slot 22.

Figure 15:
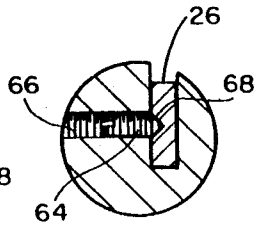
FIG. 15 is an enlarged cross-sectional view of the honing mandrel of FIG. 11, showing another alternative wedge retaining means associated therewith which alternative wedge retaining means also being usable with the honing mandrels shown in FIGS. 1, 4, 16 and 17.
Figure 14:
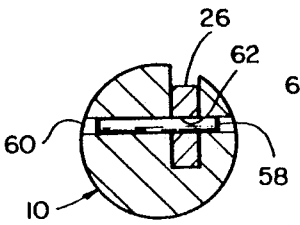
FIG. 14 is an enlarged cross-sectional view of the honing mandrel of FIG. 11, showing alternative wedge retaining means associated therewith which alternative wedge retaining means also being usable with the honing mandrels shown in FIGS. 1, 4, 16 and 17.
Figure 17:
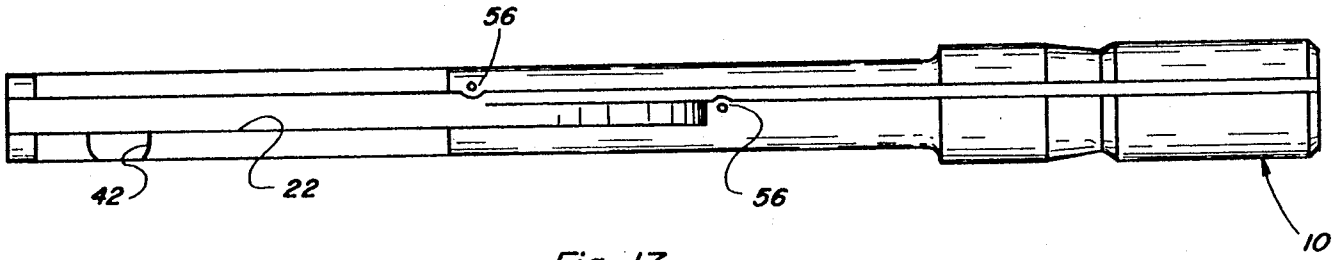
FIG. 17 is a top plan view of the honing mandrel construction of FIG. 16.

An alternative embodiment is to form a portion of the slot 22 extending through the shank portion 14 so as to be only sufficiently wide to receive the wedge member 26 and allow axial movement thereof, and to peen or stake as at 56 portions of the edge or edges of the mandrel body defining the narrowed slot 22 so that the peened portions extend over or overhang the wedge 26 and prevent the wedge from lifting or tilting therein, as shown in FIGS. 11 and 17. Another embodiment can include a pin such as a roll pin 58 located in an intermediately located laterally extending bore 60 in the mandrel body, which laterally extending pin 58 cooperatively engages an axially extending groove or slot 62 formed in one side of or through the wedge member 26, as shown in FIG. 14. The pin 58 moves along the slot 62 as the wedge member 26 is moved axially so as to retain the wedge member 26 in its bottomed position in the slot 22. Another embodiment can include a threaded member such as a set screw 64 threadedly engaged in a laterally extending intermediately located threaded bore 66 in the mandrel body 10, which set screw 64 cooperatively engages and is movable along an axially extending groove or slot 68 formed in one side of the wedge member 26 in the above described manner, as shown in FIG. 15. Importantly, a mandrel body having any of the above discussed embodiments of containment means for the wedge member 26 can be used to accommodate wedge members with or without the present positive retracting means associated therewith such that a given mandrel body can be alternatively retractable or non-retractable, as desired.

Figure 12:
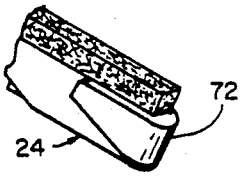
FIG. 12 is an enlarged fragmentary perspective view of a stone assembly for use with the honing mandrel construction shown in FIG. 11.
Figure 13:
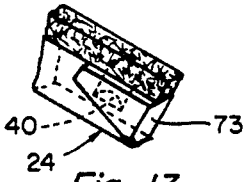
FIG. 13 is an enlarged fragmentary perspective view of an alternative stone assembly for use with a honing mandrel construction such as shown in FIG. 11 having a cut-out (not shown) for receiving the lug of the stone assembly.
Figure 18:
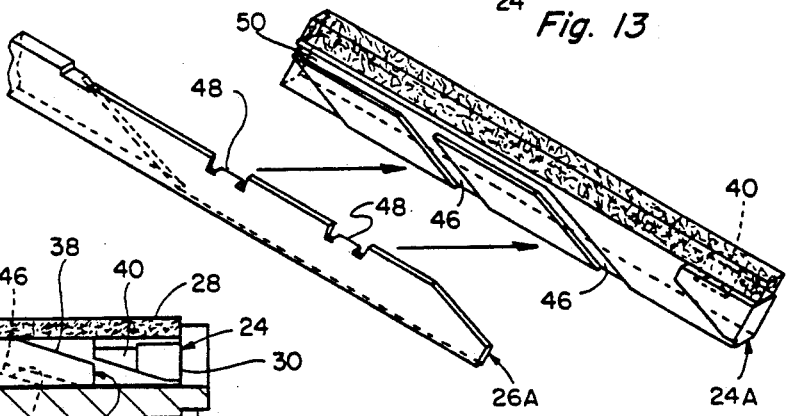
FIG. 18 is an enlarged fragmentary perspective view of an alternative stone assembly and wedge member construction for the honing mandrel of FIG. 1.
Figure 16:
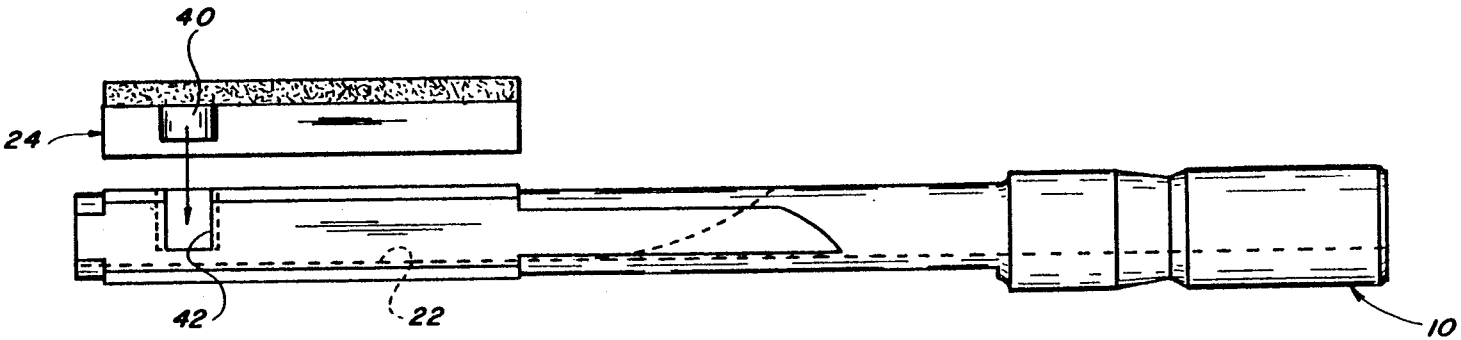
FIG. 16 is an enlarged side elevational view of another alternative construction of the honing mandrel of FIG. 1, showing a stone assembly associated therewith.

Another important feature of the present retracting and retaining means 12 is that they can be incorporated into a wide variety of new and existing honing mandrel constructions. For instance, already mentioned above is the alternative mandrel body construction wherein the end of the slot 22 adjacent the work engaging end of the mandrel body 10 is closed as at 70, as shown in FIG. 11. This closed-ended construction provides a stronger and more rigid honing mandrel and may be used to further act to prevent axial movement of the stone assembly 24 in the slot so as to eliminate the need for means such as the lug 40 on the stone assembly and the cut-out 42 on the mandrel 10 for preventing axial movements of the stone assembly. The end of the stone assembly 24 adjacent the closed ended slot portion 70 can have any suitable shape such as rounded shape 72 as shown in FIG. 12, or a squared-off shape 73 as shown in FIG. 13 provided other means for maintaining the axial position of the stone assembly are included such as lug 40 and cut-out 42. Another alternative mandrel embodiment is to locate the lug 40 on the stone assembly 24 on the side thereof opposite the side which engages the wedge member 26, and the cut-out 42 will then be in a corresponding side of the mandrel 10, such as shown in FIGS. 16 and 17. The slot 22 of such mandrel construction can be open ended as shown in FIGS. 16 and 17, or alternatively closed ended as at 70 as shown in FIG. 11, and can further have any desired means for containing the wedge member such as by staking 56 or the like. A honing mandrel can further include any desired number of the present retracting means associated therewith, for instance a plurality of spaced tabs 48 on an elongated wedge member 26A engageable with spaced grooves 46 on modified stone assembly 24A, as shown in FIG. 18, and alternatively a mandrel construction can have any number of stone assemblies 24 arranged in a row, each including one or more retracting means 12 (not shown).

Thus there has been shown and described several embodiments of a novel honing mandrel construction with positive means to retract and hold or retain the stone assembly and to maintain a bottomed condition for the wedge which fulfill all of the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention which is limited only by the claims which follow:

What is claimed is:

1. A honing mandrel comprising an elongated body member having a slot extending along at least a portion of its length thereof and a central longitudinally extending axis, a work engaging member positioned in the slot and radially movable therein, the work engaging member having a work engaging surface portion facing radially outwardly and a backing portion extending radially into the slot, the backing portion having a longitudinally extending side extending radially into the slot, at least one wedge surface on the backing portion adjacent the longitudinally extending side, the wedge surface being oriented at an acute angle to the axis of the elongated body member, a cam surface on the backing portion adjacent the longitudinally extending side, the cam surface being oriented at an acute angle to the axis of the elongated body member, an operator member positioned for longitudinal movement in the slot adjacent to said longitudinally extending side of the backing portion, a like number of wedge surfaces on said operator member positioned for surface to surface engagement respectively with said at least one wedge surface on the backing portion and slidably engageable therewith for radially outwardly extending said work engaging member by movement of said operator member in a first longitudinal direction in the slot, a projecting portion extending sidewardly from said operator member, said projecting portion being positioned for cooperative engagement with said cam surface when the work engaging member is radially outwardly extended to retain the work engaging member in the slot, and said projecting portion being slidably engageable with said cam surface when said operator member is moved in a second opposite longitudinal direction to positively draw said work engaging member radially inwardly in the slot.

2. The honing mandrel of claim 1 further comprising means on the elongated body member and the work engaging member for preventing longitudinal movement of the work engaging member in the slot.

3. The honing mandrel of claim 1 further comprising means for preventing tilting movement of the operator member in the slot.

4. The honing mandrel of claim 1 wherein said cam surface comprises an edge surface of a groove extending into the one side of the backing portion.

5. The honing mandrel of claim 1 wherein said work engaging member is a honing stone assembly.

6. The honing mandrel of claim 1 wherein the cam surface is parallel to the wedge surface.

7. The honing mandrel of claim 1 wherein the cam surface is angularly oriented relative to the wedge surface.

8. The honing mandrel of claim 1 wherein said projecting portion of the operator member is oriented at substantially the same acute angle as the cam surface.

9. The honing mandrel of claim 1 wherein the cam surface faces in the opposite direction from the wedge surface on the backing portion.

10. A honing mandrel comprising an elongated body member having a central longitudinal axis extending between opposite ends thereof, one opposite end of said elongated body member being a mounting end including means for mounting for rotation on a honing machine and the other opposite end being a work engaging end, a passageway extending along the length of the elongated body member and a radially facing opening to the passageway extending along at least a portion of one side of said elongated body member adjacent to the work engaging end thereof, a stone assembly located in said radially facing opening, said stone assembly having a radially outwardly facing work engaging abrasive portion and a backing portion that extends radially inwardly into the opening, said backing portion having opposite longitudinally extending sides extending radially into the opening, said backing portion including a plurality of parallel spacedly related wedge surfaces adjacent to one of said longitudinally extending side, said wedge surfaces each oriented at an acute angle to the axis of the elongated body member, a groove formed extending into said one longitudinally extending side of the backing portion, an edge defining one side of the groove forming a cam surface, the cam surface being oriented at an acute angle relative to the axis of the elongated body member, cooperatively engageable means on the stone assembly and on the body member to prevent relative axial movement therebetween, and an adjusting member located in the passageway of said elongated body member adjacent to said one longitudinally extending side of the backing portion of the stone assembly, said adjusting member having a plurality of parallel spacedly related wedge surfaces positioned and oriented for surface to surface contact respectively with the plurality of wedge surfaces on said backing portion, movement of said adjusting member in one axial direction in the passageway slidably moving the wedge surfaces of the adjusting member relative to the wedge surfaces on the backing portion to move the stone assembly radially outwardly relative to the elongated body, the adjusting member having a tab portion extending sidewardly therefrom and into the groove in the backing portion, movement of the adjusting member in a second axial direction opposite said one axial direction slidably engaging and moving the tab portion along the cam surface of the groove to positively retract the stone assembly radially inwardly into said opening.

11. The honing mandrel of claim 10 wherein said groove formed extending into said one longitudinally extending side of the backing portion includes an axially extending groove portion along which the tab portion can move when the stone assembly is in a fully retracted condition.

12. The honing mandrel of claim 10 including containment means adjacent the passageway engageable by the adjusting member to prevent radial movements thereof in the passageway.

13. The honing mandrel of claim 12 wherein the containment means includes a block member and means for attaching the block member in the passageway.

14. The honing mandrel of claim 12 wherein the containment means comprise a projection on the elongated body member cooperatively engageable with a slot in the adjusting member.

15. The honing mandrel of claim 12 wherein the containment means include means staking the elongated member adjacent at least a portion of the passageway.

16. The honing mandrel of claim 12 wherein the containment means are integrally formed on the elongated body member.

17. The honing mandrel of claim 10 wherein said cam surface is parallel to the wedge surfaces of the backing portion.

18. In a honing mandrel having an elongated member with a passageway extending along its length thereof and a central longitudinal axis, a work engaging member positioned in the passageway and radially movable therein, the work engaging member and the elongated member having cooperatively engageable means to prevent relative axial movement therebetween, an operator member positioned in the passageway adjacent to one side of the work engaging member and axially movable in the passageway, and cooperatively engageable means on the work engaging member and operator member for extending the work engaging member radially outwardly as the operator member is moved in a first axial direction in the passageway, the improvement comprising means on the work engaging member and on the operator member for positively retracting the work engaging member radially inwardly in the passageway including a cam surface on the work engaging member, the cam surface being oriented at an acute angle to the axis of the elongated body member and located adjacent to the operator member, and a sidewardly extending projection on the operator member cooperatively engageable with said cam surface to retain the work engaging member in the passageway, said projection slidably engaging the cam surface when the operator member is moved in a second axial direction opposite said first axial direction so as to positively retract the work engaging member radially inwardly in the passageway.

19. The honing mandrel of claim 18 including containment means in the passageway engageable by the operator member to prevent radial movements thereof in the passageway.

20. The honing mandrel of claim 18 further comprising an axially extending groove portion formed extending into the side of the work engaging member along which the sidewardly extending projection can move when the work engaging member is in a fully retracted position.

21. In a honing mandrel having an elongated body member having two ends, a mounting end including means for mounting for rotation on a honing machine, a work engaging end and a shank portion intermediate to the mounting end and work engaging end, a passageway extending along the length of the elongated body member and a radially facing opening to the passageway extending along at least a portion of one side of the elongated body member adjacent to the work engaging end thereof, a stone assembly located in the radially facing opening, the stone assembly having a radially outwardly facing work engaging abrasive portion and a backing portion that extends radially inwardly into the opening, the backing portion including at least one wedge surface oriented at an acute angle to the axis of the elongated body member, cooperatively engageable means on the stone assembly and on the elongated body member to prevent the stone assembly from moving axially in the passageway, and an adjusting member located in the passageway adjacent to one side of the backing portion and having at least one wedge surface positioned and oriented for surface-to-surface contact respectively with the at least one wedge surface on the backing portion of the stone assembly, movement of the adjusting member in one axial direction in the passageway slidably engaging the at least one wedge surface thereof with the at least one wedge surface of the backing portion to move the stone assembly radially outwardly relative to the elongated body, the improvement comprising containment means on the elongated body member positioned adjacent the passageway for slidably engaging the adjusting member to prevent the adjusting member from moving radially in the passageway, and means on the stone assembly and on the adjusting member for positively retaining and retracting the stone assembly including a cam surface on the side of the backing portion adjacent to the adjusting member, said cam surface being oriented at an acute angle to the axis of the elongated body member, and a sidewardly extending projection on the adjusting member cooperatively engageable with the cam surface to retain the adjusting member in the radially facing opening, said projection slidably engaging the cam surface when the stone assembly is in a radially outward position when the adjusting member is moved in a second axial direction in the passageway so as to positively draw the stone assembly radially inwardly in the opening.

22. An expandable rotatable honing mandrel including an elongated body rotatable about a longitudinal axis and having a passageway extending longitudinally along one side thereof, a work engaging assembly positioned in the passageway, the work engaging assembly having a radially outer work engaging portion and a radially inner backing portion having opposite longitudinally extending sides extending radially into the passageway, a pair of parallel spaced wedge surfaces on the backing portion adjacent one longitudinally extending side oriented at an acute angle relative to the axis of the body, an operator member positioned for longitudinal movement in the body passageway and having one side adjacent said one longitudinally extending side of the backing portion of the work engaging assembly, said operator member having wedge surface portions on said one adjacent side thereof engageable surface-to-surface with the acutely angularly oriented wedge surfaces on the backing portion so that longitudinal movements of the operator member in one direction in the passageway produces radial outward movement of the work engaging assembly, said work engaging assembly having a groove formed in said one longitudinally extending side, the groove having an inclined groove portion and an axially extending groove portion, a cam surface forming one edge of the inclined groove portion oriented at an acute angle relative to the axis of the body and facing oppositely relative to the wedge surfaces on the backing portion, a tab portion extending sidewardly from said adjacent side of the operator member and into the groove, the tab portion being engageable with the cam surface to retain the work engaging assembly in the passageway when the work engaging assembly is in a radially outwardly extended position, the tab portion being slidably engageable with the cam surface when the operator member is moved in a second opposite longitudinal direction to retract the work engaging assembly radially inwardly into the passageway, and the tab portion being movable along the axially extending portion of the groove when the work engaging assembly is in a fully retracted position.

23. The honing mandrel of claim 22 wherein the sidewardly extending tab formed on the operator member is oriented at approximately the same acute angle relative to the axis of the elongated body as the cam surface.

24. The honing mandrel of claim 23 wherein one edge of the axially extending portion of the groove is formed by a second surface portion engageable by the tab portion for retaining the work engaging assembly in its retracted position upon further axial movement of the operator member in said second opposite longitudinal direction.

25. The honing mandrel of claim 22 including means on the body adjacent to the passageway and engageable with the operator member to prevent radial movement of the operator member during axial movements thereof.

* * * * *